US012789958B2

(12) United States Patent
Rahimpour

(10) Patent No.: US 12,789,958 B2
(45) Date of Patent: Nov. 10, 2026

(54) AUTOMATIC RESCUE SYSTEM FOR SWIMMING POOLS

(71) Applicant: Amir Rahimpour, Hochheim am Main (DE)

(72) Inventor: Amir Rahimpour, Hochheim am Main (DE)

( * ) Notice: Subject to any disclaimer, the term of this patent is extended or adjusted under 35 U.S.C. 154(b) by 167 days.

(21) Appl. No.: 19/281,633

(22) Filed: Jul. 26, 2025

(65) Prior Publication Data

US 2026/0274385 A1 Sep. 17, 2026

(51) Int. Cl.

| | |
|---|---|
| ***E04H 4/06*** | (2006.01) |
| ***B63C 9/00*** | (2006.01) |
| ***B63C 9/26*** | (2006.01) |

(52) U.S. Cl.

CPC ..... *B63C 9/26* (2013.01); *B63C 9/0005* (2013.01); *E04H 4/065* (2013.01); *B63C 2009/265* (2013.01)

(58) Field of Classification Search

CPC ... B63C 9/26; B63C 2009/265; B63C 9/0005; E04H 4/065

See application file for complete search history.

(56) References Cited

U.S. PATENT DOCUMENTS

| | | | | |
|---|---|---|---|---|
| 5,271,483 | A * | 12/1993 | Hong | B66F 7/02 52/126.5 |
| 5,832,547 | A * | 11/1998 | Burroughs | E04H 4/065 4/504 |
| 11,624,197 | B1 * | 4/2023 | Mc Gill | E04H 4/065 4/495 |
| 2009/0235446 | A1 * | 9/2009 | Juracek | E04H 4/065 4/495 |
| 2012/0131742 | A1 * | 5/2012 | Bernard | E04H 4/065 4/495 |
| 2023/0279682 | A1 * | 9/2023 | Roberts | B66D 1/7447 4/495 |

* cited by examiner

*Primary Examiner* — Andrew Polay

(57) ABSTRACT

An automatic rescue system for swimming pools includes a floor-spanning net secured to high-tensile ropes that are wound around reversible drive shafts mounted along opposed longitudinal pool walls. Deflection pulleys guide the ropes so the net can be moved synchronously from the pool bottom to a position at or above the water surface. A control unit monitors at least one of pressure/weight, motion, hydro-acoustic, ultrasonic or radio-tag sensors; when a person, animal or object in distress is detected, the unit energizes geared motors at both ends of each shaft to lift the net. A mechanical or electromagnetic brake prevents unintended descent, particularly during power loss. The net is made of chlorine- and UV-resistant high-strength polymer fibers. Wearable RFID, BLE or UWB tags identify authorized swimmers, and absence of a tag initiates an alarm. All active components meet at least IP-68 ingress protection. A manually or externally triggered variant omits the sensor and control features.

15 Claims, 3 Drawing Sheets

AUTOMATIC RESCUE SYSTEM FOR SWIMMING POOLS

2. FIELD OF THE INVENTION

The present invention relates to water-safety equipment and, more particularly, to automated rescue systems for swimming-pools that combine real-time detection of a person or animal in distress with a mechanically actuated lifting net capable of elevating the subject from the pool bottom to or above the water surface.

3. BACKGROUND

Drowning remains a major public-health problem: more than 4,500 people died from drowning each year in the United States during 2020-2022, an increase of about 500 deaths per year compared with 2019. Children aged 1-4 are at the highest risk; in 2022 drowning deaths in this age group rose by 28 percent.

Existing pool-safety products such as perimeter alarms, floating motion sensors, camera based monitoring systems, and automatic pool-covers with stop-and-alert functions can detect or warn of an incident but do not actively remove the victim from the water. Delays created by false alarms, caregiver inattention, or the time required for manual intervention leave a critical gap during the first 30-60 seconds after submersion, when irreversible hypoxia can begin.

Accordingly, there is a need for a system that not only senses hazardous entry or submersion but also initiates an immediate mechanical response that lifts the person or animal to the surface, thereby reducing dependence on human reaction time and increasing the probability of survival.

4. SUMMARY OF THE INVENTION

This document describes an automated system designed to rescue people or animals that accidentally fall into a swimming pool. The device can raise living beings (humans, animals) as well as objects from the bottom of the pool to the surface. Its primary objective is to prevent drowning through continuous monitoring. In the event of a fall or any hazardous situation, the system activates automatically and transports the target object to the water's surface.

5. BRIEF DESCRIPTION OF THE DRAWINGS

FIG. 1 is a top-plan view of a rectangular swimming-pool equipped with the rescue system, showing the four geared-motor units (A-1, A-2, B-1, B-2), the two drive shafts (Z-1, Z-2), the vertical rope runs (X-1 . . . . X-4), and the perimeter sensor positions (S-1 . . . . S-4).

6. Reference-Numeral List

| Ref. | Component | Function/Location |
|---|---|---|
| A-1 | Geared motor-top-left corner | Drives shaft Z-1 bidirectionally |
| A-2 | Geared motor-bottom-left corner | Drives shaft Z-1 bidirectionally |
| B-1 | Geared motor-top-right corner | Drives shaft Z-2 bidirectionally |
| B-2 | Geared motor-bottom-right corner | Drives shaft Z-2 bidirectionally |
| Z-1 | Drive shaft (left) | Transmits torque between A-1 and A-2 |
| Z-2 | Drive shaft (right) | Transmits torque between B-1 and B-2 |
| X-1 | Upper pulley on Z-1 | Guides rope N (left side) above water |
| X-2 | Upper pulley on Z-2 | Guides rope N (right side) above water |
| X-3 | Lower floor pulley (right) | Redirects rope N at pool floor |
| X-4 | Lower floor pulley (left) | Redirects rope N at pool floor |
| N | Rope/steel cable | Vertical link between upper and lower pulleys |
| F | Lifting net | Raises people/objects to the surface |
| H | Bracket | Secures floor pulleys to structure |
| S-1 | Sensor-left wall | Detects movement/entry, left side |
| S-2 | Sensor-right wall | Detects movement/entry, right side |
| S-3 | Sensor-upper edge | Detects surface disturbances |
| S-4 | Sensor-lower edge | Detects pressure/mass on floor |
| D-1/D-2 | Short-side wall housings | Protect motors and shafts |
| W | Water-surface line | Height reference |

7. DETAILED DESCRIPTION

Figure 1:
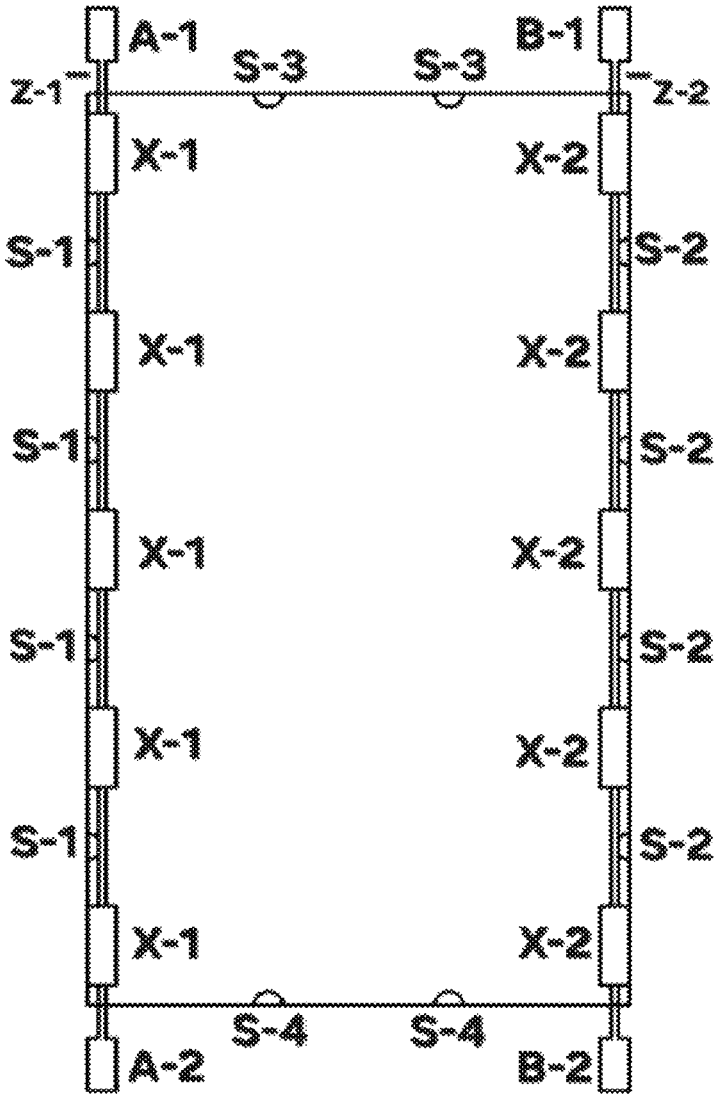

7.1 General Construction Description (FIG. 1)

FIG. 1 shows a rectangular swimming pool viewed from above. Two geared motors are installed at each of the four pool corners:

Left Side of the Pool

The geared motors A-1 (top left) and A-2 (bottom left) are coupled by a shaft named Z-1. Shaft Z-1 starts at A-1 (top left), runs along the left pool wall and ends at A-2 (bottom left). Both motors drive shaft Z-1 synchronously, at identical speed and with reversible rotation.

Right Side of the Pool

Analogously, geared motors B-1 (top right) and B-2 (bottom right) are linked by shaft Z-2. Shaft Z-2 begins at B-1 (top right), follows the right pool wall and ends at B-2 (bottom right). Here too, B-1 and B-2 rotate Z-2 at a uniform, adjustable speed in both directions.

At defined intervals along shafts Z-1 and Z-2, rope pulleys X-1 and X-2 (FIG. 1) are mounted. These mark the positions of the pulleys on shafts Z-1 (left side) and Z-2 (right side) and are responsible for holding, guiding and moving the ropes or steel cables N.

Figure 2:
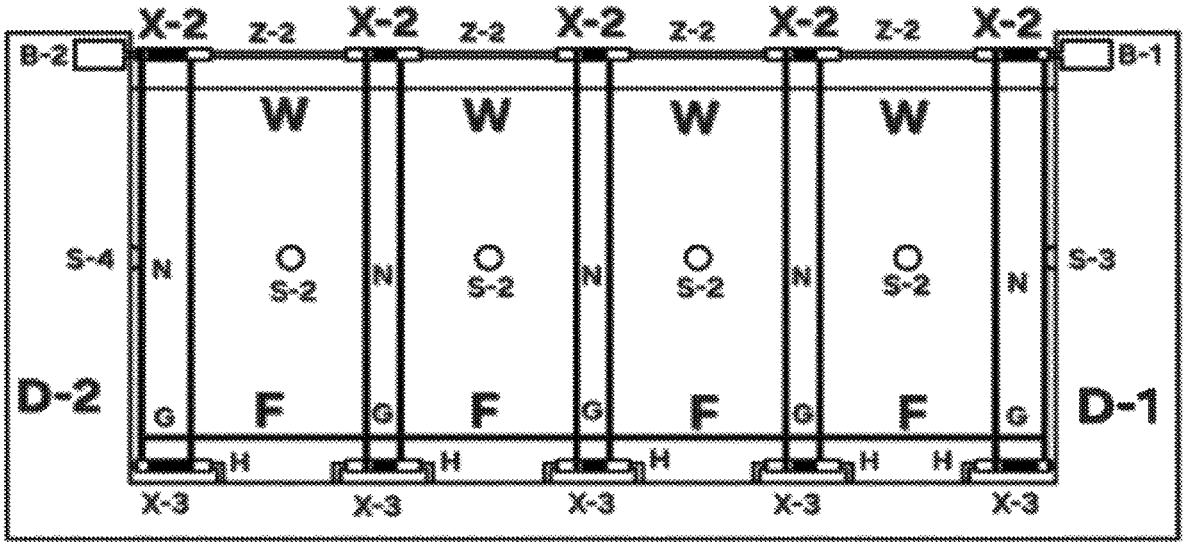
FIG. 2 is a longitudinal sectional view taken along the right-hand long side of the pool, illustrating the upper pulleys (X-2) on drive shaft Z-2, the lower floor pulleys (X-3), the lifting net (F) resting on the pool bottom, and the protective wall housing (D-1/D-2).

7.2 Rope-Guiding Mechanism (FIG. 2)

7.2.1 Upper Pulleys (X-2)

Located above the water surface W on shaft Z-2. Rotating Z-2 winds or unwinds the ropes N, thereby moving them vertically.

7.2.2 Lower Pulleys (X-3)

The corresponding X-3 pulleys are mounted on the pool floor without their own drive. Brackets H fix them to the floor or walls (central X-3 directly on the floor, lateral X-3 additionally to the wall). Robust ropes N connect X-2 and X-3 vertically without slack.

7.2.3 Vertical Movement

When the motors drive shaft Z-2, pulleys X-2 turn and move ropes N up or down. The lower X-3 pulleys rotate with them, enabling smooth, powerful vertical motion.

Figure 3:
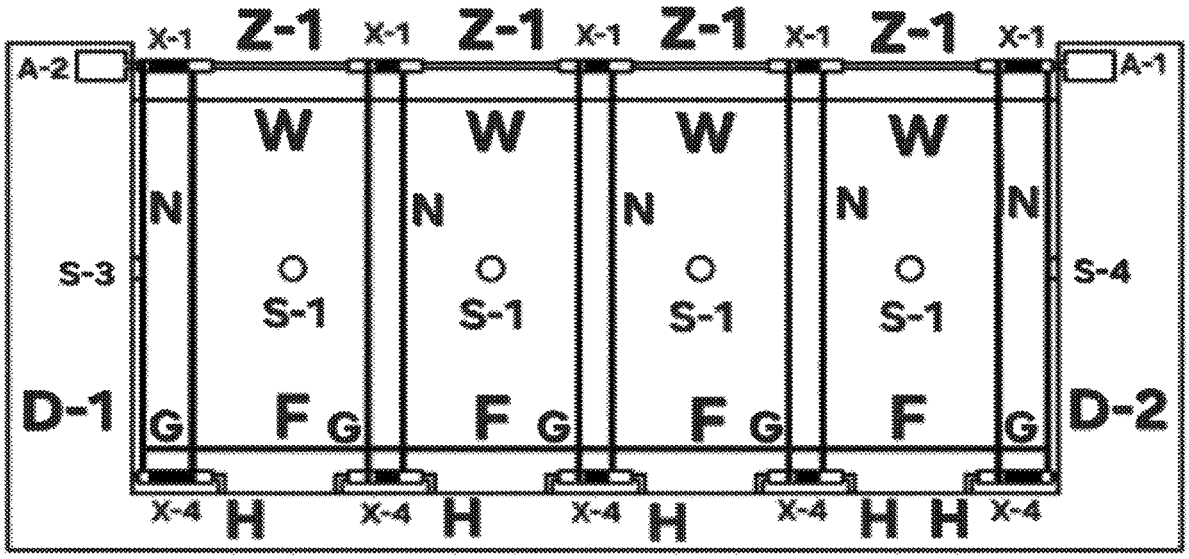
FIG. 3 is a longitudinal sectional view taken along the left-hand long side of the pool, corresponding to FIG. 2, and showing the upper pulleys (X-1) on drive shaft Z-1, the lower floor pulleys (X-4), and the attachment of the lifting net (F) to the vertical ropes (N).

X-1 and X-4 (FIG. 3)

The same mechanism is implemented on the pool's left side: shaft Z-1 with pulleys X-1 (upper) and X-4 (lower) produces the same vertical rope travel. FIG. 3 shows this mechanism on the left side; X-1 and X-4 perform the same functions as X-2 and X-3 on the right. Thus both long sides of the pool have identical, synchronized drives.

7.3 Attachment of a Supporting Net (F)

As shown in FIG. 2, a net F covering the entire pool floor rests on the bottom:

Connection to the Ropes (N)

Special clamps G fasten the net to the ropes N the right edge of the net to the ropes on shaft Z-2 (right side) and the left edge to the ropes on shaft Z-1 (left side).

Once the system is triggered, all four geared motors A-1, A-2, B-1 and B-2 start simultaneously and rotate shafts Z-1 and Z-2 at a predefined speed. The ropes N (left side via pulleys X-1 & X-4, right side via X-2 & X-3) move upward. Because the large-area net is firmly clamped to ropes on both sides, it rises like a stable, upward-moving platform (comparable to an elevator). All people, animals or objects above the net are lifted to, or even above, the water surface W, thereby being rescued.

Load Capacity and Motion

The net is engineered to safely support the weight of the persons and objects to be rescued. When the motors engage, the net together with its load is transported up to and beyond the water surface.

7.4 Monitoring Devices (Sensor Suite)

FIG. 1 shows sensors at positions S-1, S-2, S-3 and S-4 on the pool walls that continuously monitor the pool:

7.4.1 Detection of Living Beings in Water

Use of microwave, ultrasonic or hydro-acoustic sensors to reliably register underwater movement.

7.4.2 Weight and Density Filtering

Pressure sensors (load cells) or density sensors trigger an alert above a set mass threshold (e.g. 50 kg), ensuring children or animals are also detected.

7.4.3 Identification of Authorised Persons (Bracelets)

Monitoring of RFID, Bluetooth or UWB bracelets, smart-watches or animal collars. Removal or non-recognition of a bracelet triggers an alarm.

7.4.4 Environmental Robustness

All sensors meet protection class IP68 and function safely in moist or submerged areas.

7.4.5 Alarm and Control Signal

Upon detecting danger (unauthorised entry, bracelet removal), the sensors immediately signal all motors (A-1, A-2, B-1, B-2). These start simultaneously and lift the net.

Advantage of the bracelet system: swimmers who can swim may quickly remove their silicone bracelet in an emergency to trigger the system. Sensor configurations can be customised (linked with apps, smart-watches or animal collars).

7.5 Protection and Positioning of the Drive Units

Protective Covers Over Pulleys X-1 and X-2 (FIG. 1)

To avoid injury, protective housings cover the pulleys, leaving only a small slot for rope travel.

Positioning of Motor-Gear Units (FIG. 2)

Motors A-1, A-2, B-1 and B-2 are embedded in walls D-1 and D-2 (at the pool's shorter ends). Although waterproof, wall-mounting further shields them from direct water contact and reduces unauthorised access.

Water Surface (W)

In FIG. 2, W marks the waterline. Shafts and pulleys are located above this level. In an emergency, the net is raised past the water surface, rescuing people or animals from drowning.

To enhance and complete the automatic pool rescue system, the following functions are provided.

7.6 Emergency Lock Mechanism

To prevent sudden sinking or contraction of the net (F) in case of power failure or technical defects, a mechanical or electromagnetic lock is installed along shafts Z-1 and Z-2 or at the geared motors (A-1, A-2, B-1, B-2). Under normal power conditions the lock is open; upon detecting an emergency (e.g. power loss) or receiving a corresponding control signal, it engages automatically and blocks any uncontrolled movement.

7.7 Advanced Sensor Suite

Ultrasound/hydro-acoustic sensors: detect sudden movements or impacts in the water caused by a person or animal falling in.

Pressure/load cells: mounted at key points on the pool floor or the net to detect a mass above a set threshold (e.g. 30-50 kg).

RFID/Bluetooth/other radio sensors: identify special bracelets or collars; loss or removal triggers a warning.

Optional integration of temperature and time sensors: if a living being remains underwater longer than normal or if water temperature exceeds a defined limit, the system can issue a warning or activate automatically.

7.8 Smart-App Integration

The system can be controlled via a central control unit or a mobile app (smartphone/tablet) offering:

- Real-time monitoring: display of sensor status, current net position and height, and any warnings or error messages.
- User-specific settings: the user can adjust pressure-sensor thresholds or motion-sensor sensitivity, and set schedules or scenarios (e.g. pool party, maintenance).
- Logging: all events—system activation/deactivation, alarms and other operations are recorded and can be reviewed later.

7.9 Resistance to Environmental Influences

All electronic and mechanical components in direct or indirect contact with water meet strict water- and corrosion-protection standards (e.g. IP68). The materials used for the net (F) and clamps (G) are resistant to chlorine and other pool chemicals.

7.10 Operational Sequence Upon Hazard Detection

Detection: one or more sensors send an emergency signal (e.g. after a heavy object suddenly enters the water).

Early warning: a warning immediately appears on the central panel or in the app so that people on site can react quickly.

Activation of the lifting mechanism: the central control unit starts the geared motors (A-1, A-2, B-1, B-2) while the emergency lock releases for upward movement. The net (F) is lifted from the pool bottom to or above the water surface.

Securing: once the desired height is reached, the emergency lock re-engages, holding the net so that people or animals can be safely retrieved.

Logging: every step is stored in the system or app log and can be traced at any time.

7.11 Extended Application Possibilities

The system can be used not only in private or public swimming pools but also in fish ponds or industrial water reservoirs. By adapting the sensor suite, the installation can be flexibly tailored to various fields of application.

The invention claimed is:

1. An automatic rescue and lifting system for a swimming pool, comprising:

(a) a large-area net (F) sized to cover an entire floor of the pool;

(b) a first reversibly drivable shaft (Z-1) disposed along a first longitudinal wall of the pool and a second reversibly drivable shaft (Z-2) disposed along an opposing longitudinal wall of the pool, each shaft being driven at opposing ends by two geared motors (A-1, A-2; B-1, B-2) so as to rotate synchronously;

(c) guide and deflection pulleys (X-1 to X-4) mounted on the shafts and on the pool floor and/or pool walls;

(d) high-tensile traction members (N) guided by the pulleys and fixed to the net by clamps (G) such that rotation of the shafts moves the net synchronously or quasi-synchronously in a vertical direction between the pool floor and at least a water surface (W);

(e) a sensor arrangement (S-1 to S-4) comprising at least one sensor selected from the group consisting of: pressure/weight sensors, motion/hydro-acoustic/ultrasonic sensors, and radio-transponder sensors (RFID, BLE, UWB);

(f) a control unit configured (i) to activate all geared motors upon receipt of an emergency signal from the sensor arrangement and (ii) to monitor a permissible synchronization deviation between the first and second shafts and inhibit upward movement of the net when the deviation exceeds a preset threshold; and (g) a spring-applied, power-released mechanical or electromagnetic locking or braking device (L) configured to prevent unintended lowering of the net upon power failure or after the net reaches a target position.

2. The system of claim 1, wherein the sensor arrangement is configured to generate the emergency signal when an adjustable threshold value for mass acting on the net is exceeded.

3. The system of claim 2, wherein the pressure/weight sensors comprise load cells mounted beneath the net or on the pool floor.

4. The system of claim 3, wherein the sensor arrangement comprises hydro-acoustic or ultrasonic sensors that detect sudden movements or impacts in the water.

5. The system of claim 4, wherein absence or removal of an authorized radio transponder worn by a person or animal generates the emergency signal.

6. The system of claim 5, wherein the net is fabricated from a chlorine- and UV-resistant high-strength polymer-fiber composite.

7. The system of claim 6, wherein the locking or braking device is an electromagnetic disc brake operating on a "spring-engaged, power-released" principle and is capable of holding the net at any intermediate height.

8. The system of claim 7, wherein all active components meet at least protection class IP68.

9. The system of claim 5, wherein the radio transponder is implemented as an ultra-wideband (UWB) transmitter providing position determination within the pool.

10. A lifting device for swimming pools, comprising the features recited in sub-clauses (a) through (d) and (g) of claim 1, but lacking the sensor arrangement and control unit of sub-clauses (e) and (f), wherein activation of the shafts is effected manually or by an external control signal.

11. A method of rescuing a living being in a swimming pool using the system of claim 1, comprising:

(i) continuously monitoring the sensor arrangement of claim 1;

(ii) detecting a hazardous event when at least one predetermined threshold is exceeded;

(iii) releasing the locking or braking device (L) and simultaneously activating all geared motors;

(iv) raising the net (F) from the pool floor to a position at or above the water surface; and (v) re-engaging the locking or braking device (L) to secure the net in a safe position.

12. The method of claim 11, further comprising generating an audible or visual alarm on an operator panel or mobile application concurrently with step (ii).

13. The method of claim 12, wherein step (i) includes monitoring for loss of a wearable radio transponder signal.

14. The method of claim 13, wherein step (iv) is aborted when the control unit detects a synchronization deviation between the shafts that exceeds the preset threshold.

15. The method of claim 14, further comprising logging each step in a time-stamped event log accessible via the operator panel or mobile application.

* * * * *